US006609397B1

(12) United States Patent
Haltenhof

(10) Patent No.: US 6,609,397 B1
(45) Date of Patent: Aug. 26, 2003

(54) METHOD FOR FORMING NEW STITCHES ON A KNITTING MACHINE

(75) Inventor: Hans-Guenther Haltenhof, Pfullingen (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/717,843

(22) Filed: Nov. 21, 2000

(30) Foreign Application Priority Data

Dec. 22, 1999 (DE) ..... 199 62 032

(51) Int. Cl.[7] ..... D04B 7/00
(52) U.S. Cl. ..... 66/75.1; 66/64; 66/77
(58) Field of Search ..... 66/64, 67, 68, 66/69, 75.1, 76, 96 R, 109

(56) References Cited

U.S. PATENT DOCUMENTS 4,905,483 A * 3/1990 Shima ..... 66/64
5,343,719 A * 9/1994 Nakamori et al. ..... 66/64
5,367,892 A * 11/1994 Shima et al. ..... 66/64
5,557,948 A * 9/1996 Shima et al. ..... 66/64
6,018,966 A * 2/2000 Shima ..... 66/64
6,047,569 A * 4/2000 Shima ..... 66/64
6,079,231 A * 6/2000 Shima ..... 66/64
6,109,067 A * 8/2000 Shibuta ..... 66/64
6,178,782 B1 * 1/2001 Takeda et al. ..... 66/64

* cited by examiner

*Primary Examiner*—Danny Worrell
(74) *Attorney, Agent, or Firm*—Michael J. Striker

(57) ABSTRACT

New stitches on knitting machines are formed by producing two stitches from one stitch suspended on a knitting needle, in that the stitch suspended on the knitting needle is transferred by a transfer element associated with the knitting needle and subsequently a new stitch loop is pulled from the knitting needle through the stitch suspended on the transfer element.

7 Claims, 9 Drawing Sheets a)

b)

METHOD FOR FORMING NEW STITCHES ON A KNITTING MACHINE

BACKGROUND OF THE INVENTION

The present invention relates to a method for forming new stitches on a knitting machine.

During the production of knitted articles, it is always required to form new, additional stitches, for example for expanding a knitted article or for producing a double-surface section in the knitted article, substantially in the region of a pocket of an article of clothing. The new stitches are formed so that, with an empty knitting needle in the first knitting row the thread is only caught. In the second knitting row this tuck loop is knitted, so that a complete stitch is produced. The points where new stitches are formed by tuck loops are however visible in the finished knitted article in form of small holes. During expanding of a knitted article, these so-called "cover holes" are frequently covered by stitches which are formed on the needles and not required for the knitting process of the knitted article. These stitches for covering must be however transferred by the needles on which they are formed, with the use of a transfer process, to such needles which form the tuck loop for the new stitches. These transfer processes however require machine time in which no production progress is achieved on the knitted article, and therefore increase the production time for the knitted product. Moreover, this covering is possible only for individual stitches which are formed in the same needle bed.

With initial knitting rows of double-surface sections, the so-called "initial holes" can not be covered by any process of the knitting machine, and therefore are visible in each case on the finished knitted product, which naturally reduces the quality of the knitted article.

SUMMARY OF THE INVENTION

Accordingly, it is an object of present invention to provide a method and a device, with which new stitches can be formed without forming optically disturbing holes in the knitted product during formation of the stitches.

In keeping with these objects and with others which will become apparent hereinafter, one feature of present invention resides, briefly stated in a method for forming new stitches on a knitting machine, in accordance with which from one stitch hanging on a knitting needle two stitches are formed, in that the stitch hanging on the knitting needle is taken by a transfer element associated with the knitting needle and subsequently by the stitching needle a new stitch loop is pulled through the stitch hanging on the transfer element. An additional complete new stitch is produced from the initial stitch which hangs at the end of the stitch forming process on the transfer element. The new stitch hangs in the knitting needle at the end of the stitch forming process. The stitch which hangs on the stitch transfer element can be subsequently transferred to be suspended on another knitting needle and serve as a starting stitch for the new small stitch bar.

The new stitches which are formed in this process are later are not visible in the final knitted product as holes. Moreover, a perfect knitted article is produced, regardless of the number of the new formed stitches.

In a knitting machine with latch needles, the needle can be advanced so far that the stitch is located behind the open latch, then a thread is introduced into the needle, and it is pulled back so far that the stitch lies on the closed latch before the stitch transfer element associated with the needle is driven and inserted between the legs of the stitch, and subsequently the needle is pulled back so that the initial stitch hangs on the stitch transfer element and in the needle which forms the new stitch.

It is also possible that the needle is advanced only so far that the stitch lies on the open latch, subsequently the stitch transfer element associated with the needle is driven and introduced between the legs of the stitch, and then the needle is driven further and a knitting thread is inserted, which by pulling back of the needle is pulled through the stitch which hangs on the stitch transfer element, so that the initial stitch hangs on the stitch transfer element and the newly formed stitch hangs in the needle. There is also a possibility to take the stitches both on the open needle latch and on the closed needle latch. In both cases, the stitch is prestressed, so that the stitch transfer element can be inserted between the stitch legs.

In a knitting machine with slide needles, the needle can be driven with the open slide so far until the stitches are located behind the open slide, subsequently a thread is inserted in the needle and the slide is closed, and the needle is pulled back so far that the stitch lies on the closed slide before the stitch transfer element associated with the needle is driven and inserted between the legs of the stitch, and subsequently the needle is pulled back so that the original stitch hangs on the stitch transfer element and the new formed stitch hangs in the needle.

The inventive method can be used regardless of the type of the needles. It is moreover equally suitable for flat knitting machines and round knitting machines.

The inventive knitting machine for performing an inventive method has for all needles with which the new stitches must be sold, an associated transfer element which is drivable to the mesh forming region of the knitting machine.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
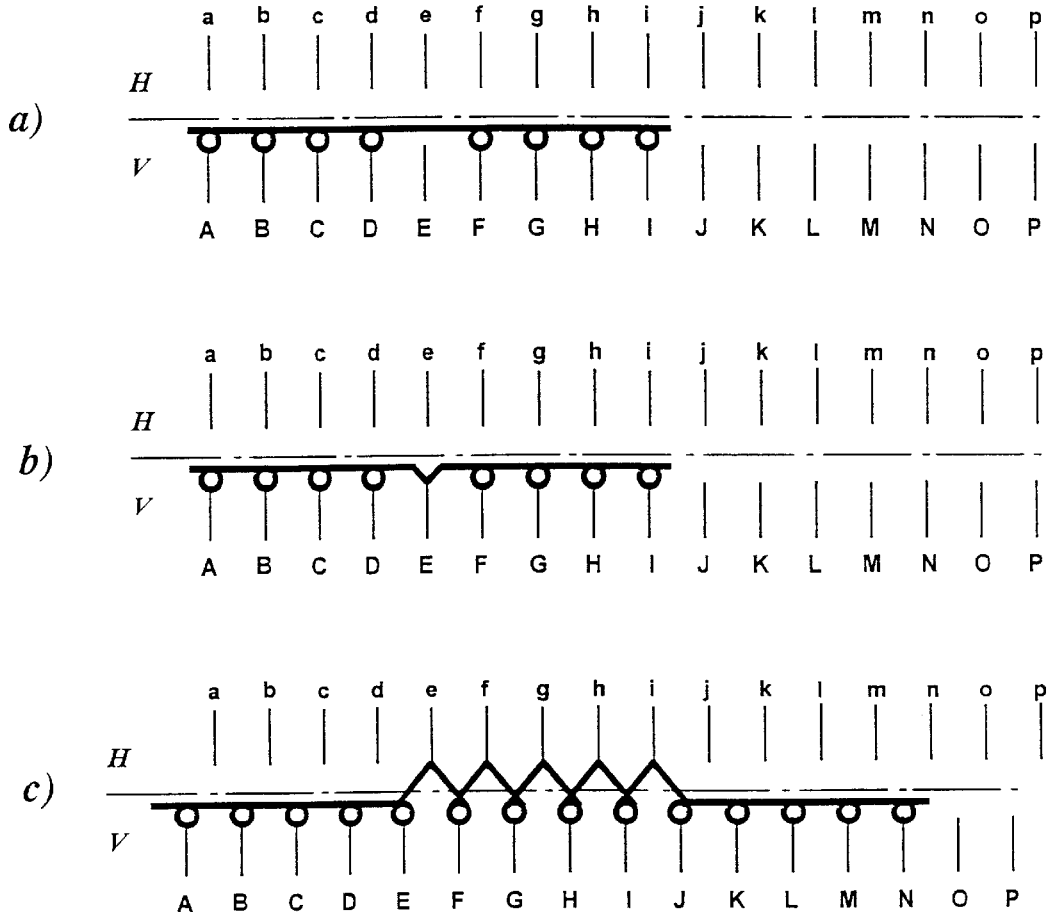
FIGS. 1*a*, 1*b*, 1*c* are views showing stitch courses for producing new stitches in accordance with a prior art method.

FIGS. 1*a* and 1*b* show a widening of a knitted product by a lateral transfer in accordance with a method corresponding to the prior art. In FIG. 1 the thread course is shown, in accordance with which the stitches of the needles E, F, G, and H are transferred to the right by one needle. Thereby the needle E is free and the total knitting width is expanded by one stitch. In the first knitting row after the lateral transfer of the stitches, a tuck loop is formed in the freely remaining needle E, as shown in FIG. 1*b*. This tuck loop is later seen in a so-called "cover hole" in the final knitted product. First, in the next knitting row, the tuck loop is knitted to form a complete stitch.

FIG. 1*c* shows the formation of an initial row for a double-surface section of a knitted product in accordance with the prior art. In the region of the needles e, f, g, h, and i the tuck loops are formed as a starting row for a partial knitted product formed on the rear needle bed H. In the subsequent knitting row the needles e, f, g, h, and i form a stitch. The tuck loops on these needles are later also seen as holes in the knitted product.

Figure 2:
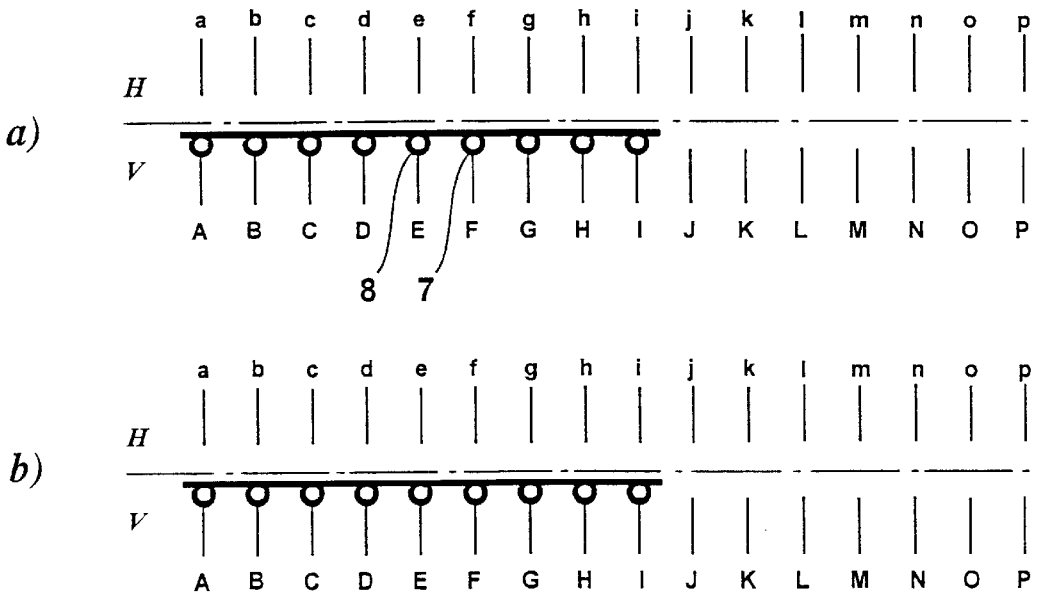
FIGS. 2*a*, 2*b* are views showing a stitch course for expanding a knitted article by a lateral transfer in accordance with the present invention.

In contrast FIGS. 2*a*, 2*b* show the formation of new stitch for expansion of a knitted product in accordance with the inventive method. In FIG. 2 the needle E performs a stitch doubling. The stitch 7, which is transferred on the stitch transfer element 5 in a stitch doubling process as described for example in FIGS. 4*a*–4*f* is transferred to the right together with the stitches of the needle F, G, and H by one needle. The previously empty needle I is provided with a stitch and thereby the knitted product is expanded by one needle. By means of the stitch 8 which is formed in the stitch doubling process of the needle E, the stitch structure is closed by the needle A to I from the beginning, to produce no "cover hole". With the first knitting row after the lateral transfer all needles A to I form the stitches (FIG. 2*b*).

Figure 3:
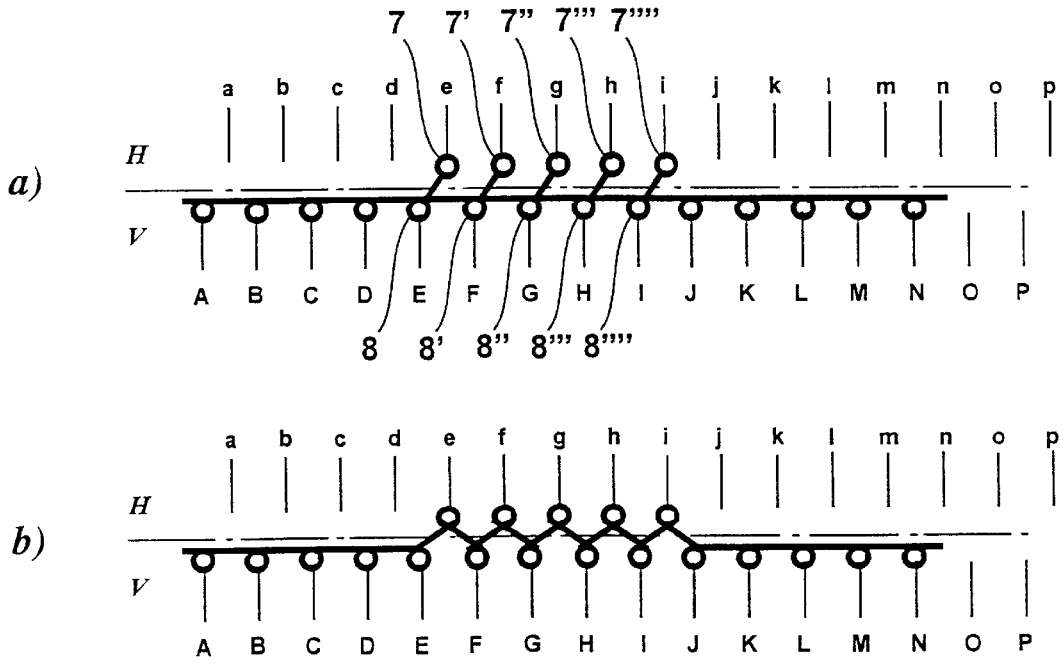
FIGS. 3*a*, 3*b* are views showing a stitch course for forming an initial row during the transition from a one-surface knitted product to a two-surface knitted product with the use of an inventive method.

FIG. 3 shows the stitch course during transfer from a single-surface knitted product to a locally two-surface knitted product with formation of new stitches in accordance with the inventive method. In contrast to the method of the prior art shown in FIG. 1*c*, here the initial row is composed of complete stitches 7, 7', 7", and 7'", from which with the inventive stitch double process the new stitches 8, 8', 8", 8'" and 8"" are originated (FIG. 3*a*). FIG. 3*b* shows that a first knitting row, in which all needles of the initial row participating in the knitting process form stitches. In the front needle bed, there are the needles A to N and in the rear needle bed there are needles e to i.

Figure 4A:
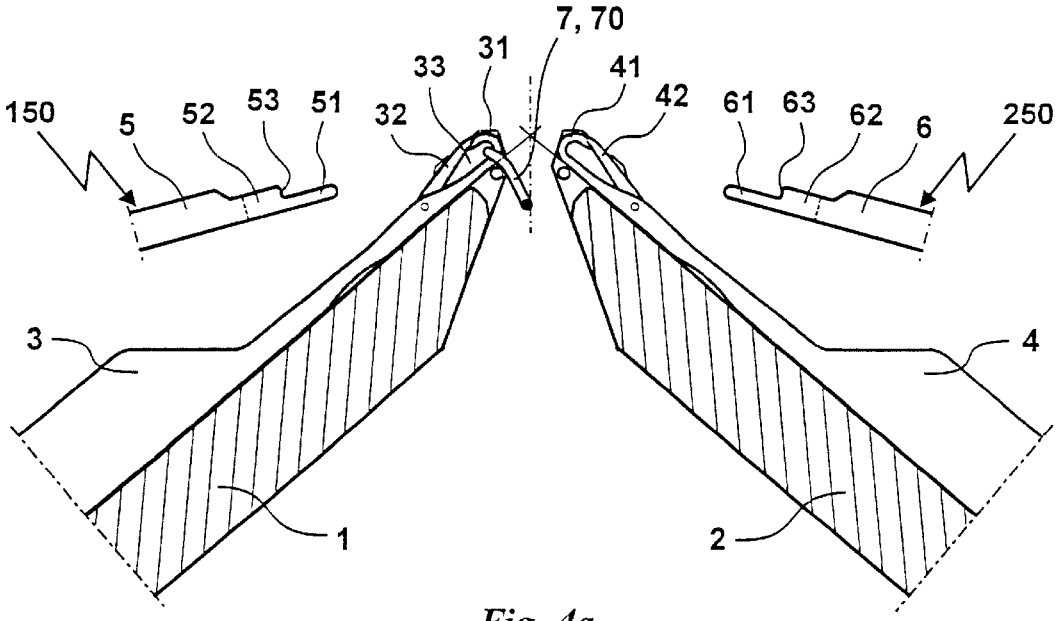
FIGS. 4*a*–4*f* are views showing a partial section through the front and rear needle bed of a flat knitting machine with stitch transfer elements with different needle and transfer element positions during the production of a new stitch in accordance with the inventive method.
Figure 4B:
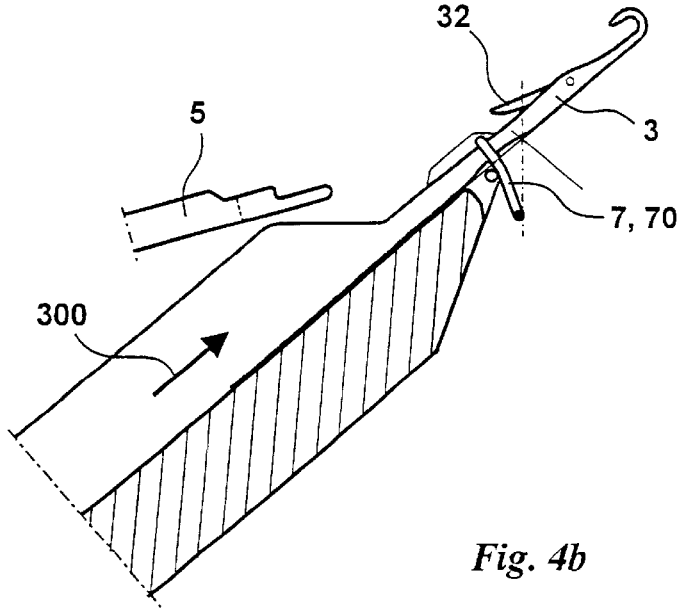
Figure 4C:
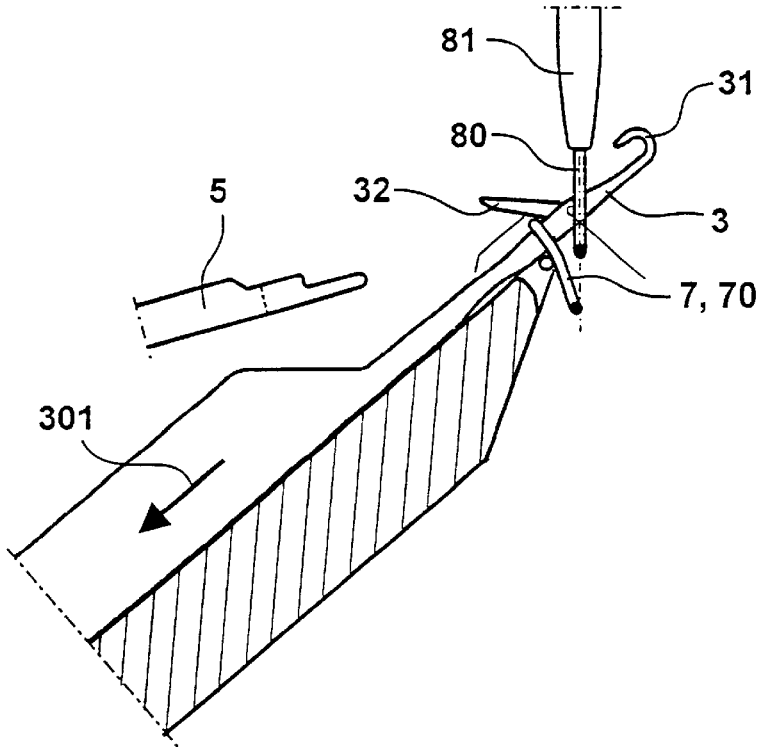
Figure 4D:
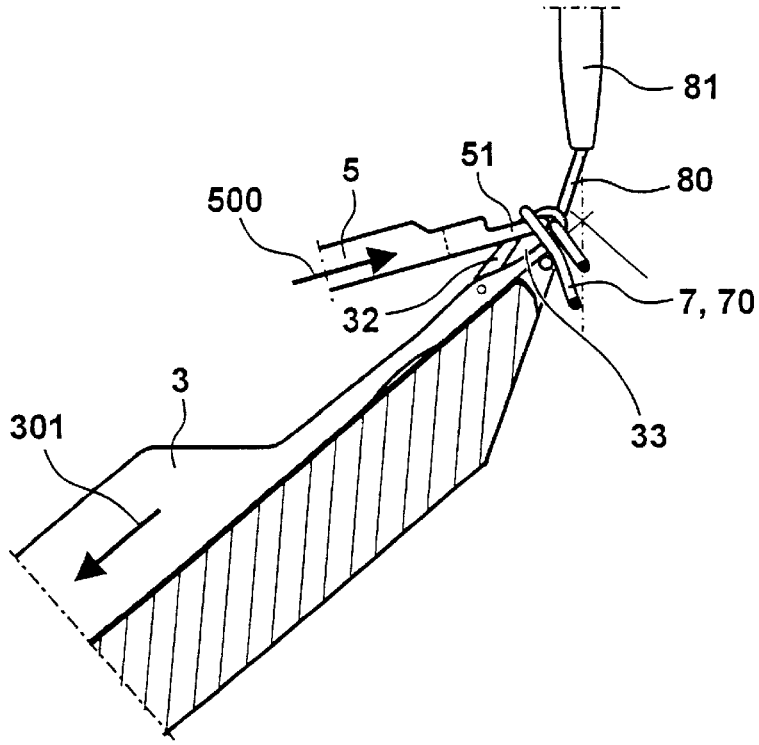
Figure 4E:
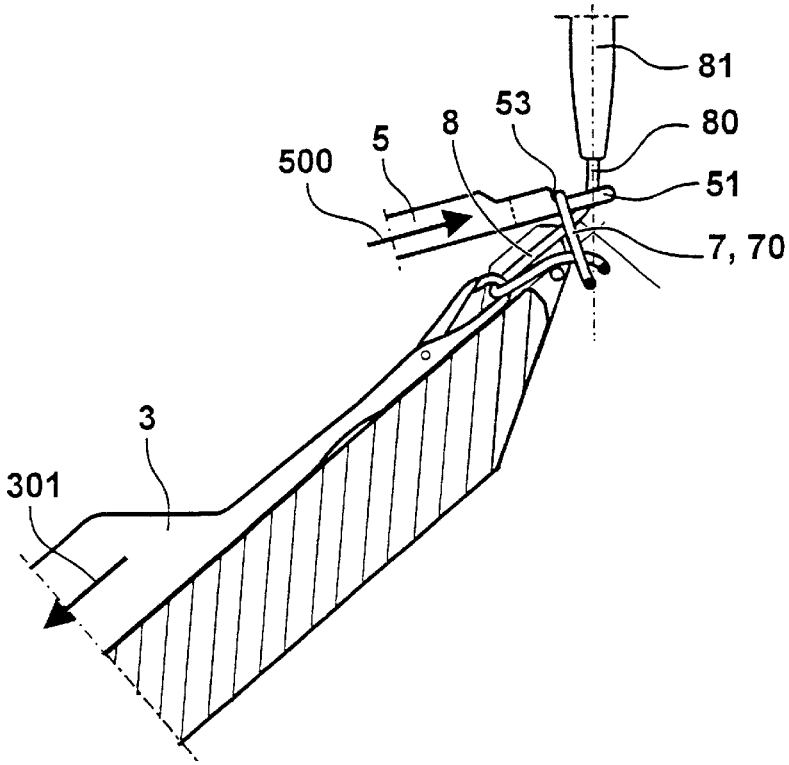
Figure 4F:
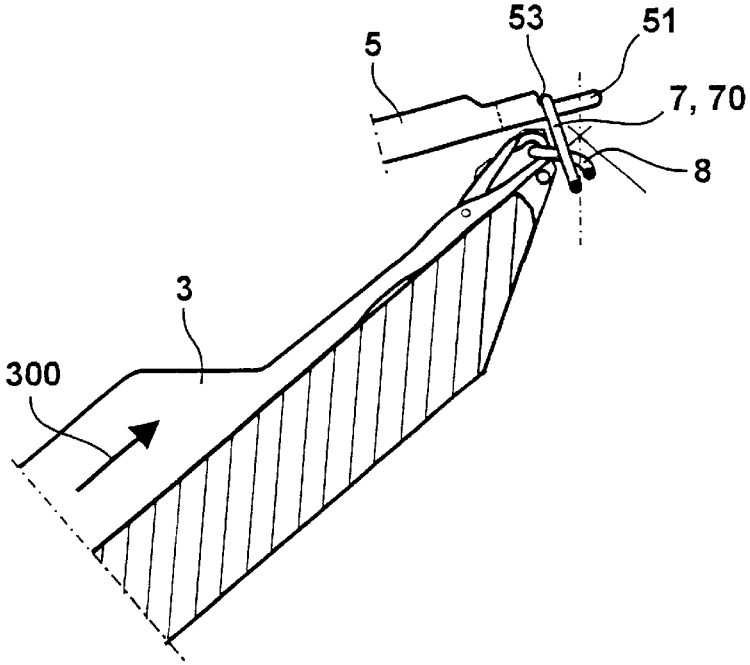

In FIGS. 4*a*–4*f* which are transverse cross-sections, the inventive stitch doubling process by the needles 1 and 2 of a flat knitting machine is shown in different positions of the participating needles 3 and 4, as well as the stitch transfer elements 5 and 6. In FIG. 4*a* the needles 3 and 4 as well as the stitch transfer elements 5 and 6 are located in their basic position. A stitch 7 is located in the hook 31 of the needle 3 and formed by a knitting thread 70. In FIG. 4*b* the needle 3 is driven in direction of the arrow 300 so far that the stitch 7 comes to lie behind the open latch 32 of the needle 3. Subsequently, as shown in FIG. 4*c*, a further knitting thread 80 is inserted in the hook 31 of the needle 3 by means of a thread guide 81. The needle 3 is pulled back in direction of the arrow 301 until the stitch 7 slides on the closed latch 32 of the needle 3, and simultaneously the stitch transfer element 5 is driven in direction of the arrow 500 so far that the tip 51 of the stitch transfer element 5 is introduced into the stitch 7 as shown in FIG. 4*d*. Then the needle 3 is pulled back further in direction of the arrow 301, whereby a new stitch 8 is formed in the needle 3. The original stitch 7 is suspended now alone on the stitch transfer element 5, which simultaneously is driven further in direction of the arrow 500. Thereby the stitch 7 comes to lie on an abutment 53 of the stitch transfer element 5. FIG. 4*f* shows the needle 3 after its driving in direction of the arrow 300 in its basic position. Both stitches 7 and 8 are now available for further transfer or stitching process.

Figure 5A:
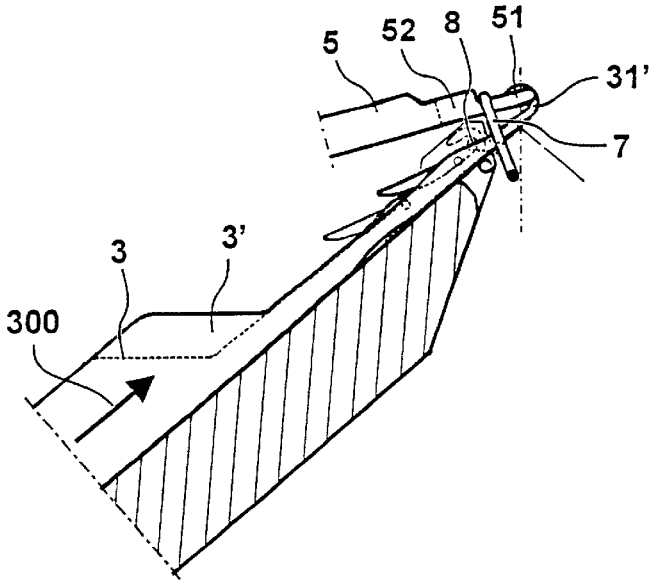
FIGS. 5*a*–5*c* are views showing a partial cross-section through a needle bed of a flat knitting machine with different transfer element and needle positions during the transfer of a stitch from the stitch transfer element to a needle of the same needle bed.
Figure 5B:
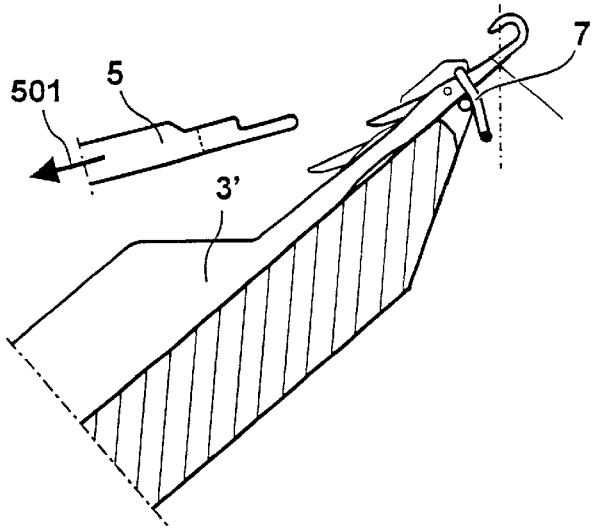
Figure 5C:
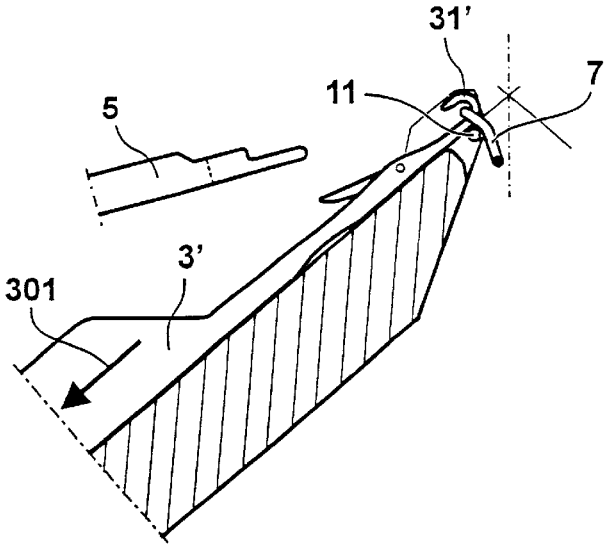

FIGS. 5*a*–5*c* describe for example the transfer of the stitch 7 suspended on the transfer element 5 to another needle 3' of the same needle bed. For this purpose the stitch transfer element 5 of the needle bed is first laterally offset, so that the stitch transfer element comes to lie in the region of the needle 3'. The needle 3' is driven in direction of the arrow 300 so that its needle hook 31' is inserted between the legs of the stitch 7 as shown in FIG. 5*a*. Then the stitch transfer element 5 is pulled back in direction of the arrow 501 so that the stitch 7 now is suspended alone on the needle 3' as shown in FIG. 5*b*. The needle 3' is pulled back in direction of the arrow 301 to its basic position, so that the stitch 7 lies in the hook 31' of the needle 3'.

Figure 6A:
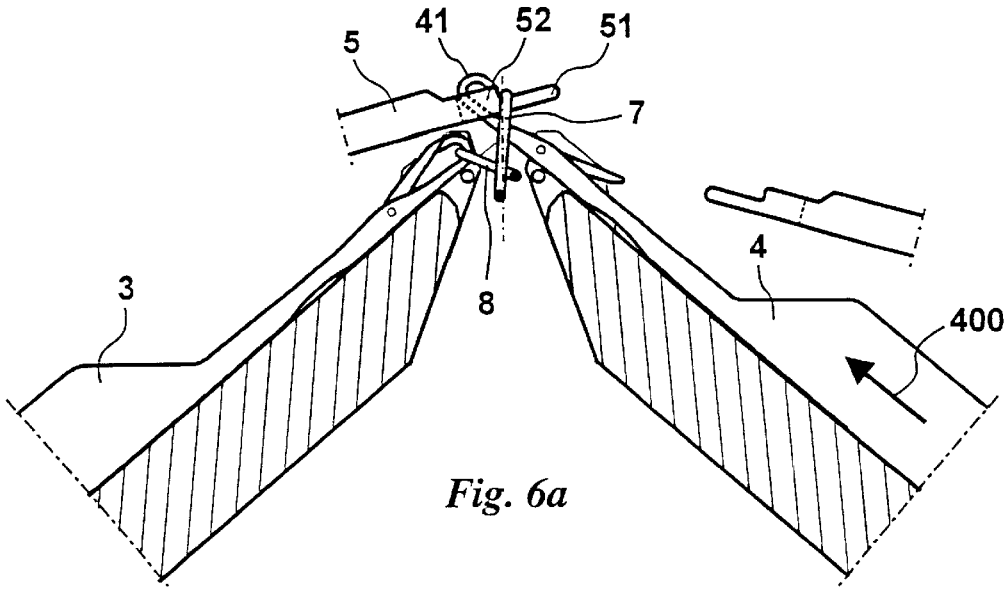
FIGS. 6*a*–6*c* are views showing a partial section through the front and rear needle bed of a flat knitting machine with different needle and transfer element positions during the transfer of a stitch from the transfer element to a needle of the opposite needle bed.
Figure 6B:
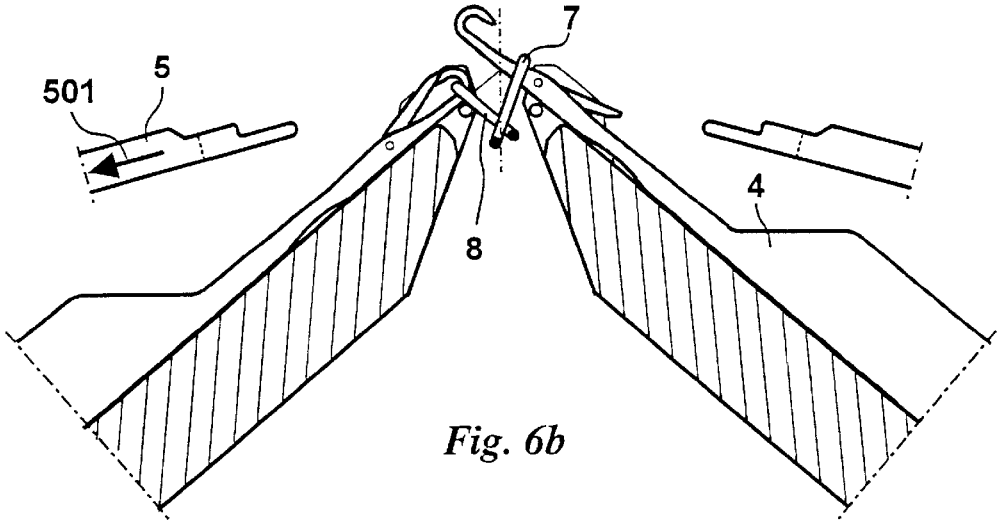
Figure 6C:
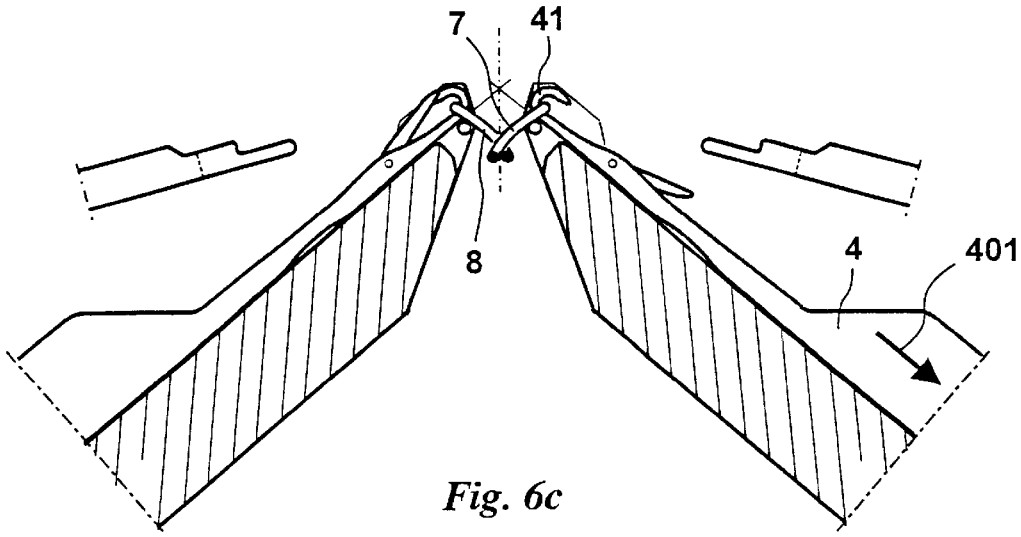

Alternatively to the transfer of the stitch 7 to a needle 3' of the same needle bed, naturally it is also possible to provide transfer of the stitch 7 from the transfer element 5 to a needle 4 of the oppositely located needle bed. This transfer process is illustrated in FIGS. 6*a*–6*c* which show partial transverse cross-sections of both needle beds of a flat knitting machine. The needle 4 is driven in direction of the arrow 400 so far that its needle hook 41 is inserted between the legs of the stitch 7. Subsequently, the stitch transfer element 5 is pulled back in direction of the arrow 501 as shown in FIG. 6*b*, before the needle 4 is pulled back in direction of the arrow 401 to its basic position. The stitch 7 is now located in the hook 41 of the needle 4. The stitch 8 which is newly formed in the stitch forming process, to the contrary is suspended in the needle 3 of the opposite needle bed. This position of the stitches 7 and 8 corresponds to the positions of the stitches 7, 8, 7', 8', 7", 8", 7'", 8'", 7"", 8"" shown in FIG. 3.

Figure 7:
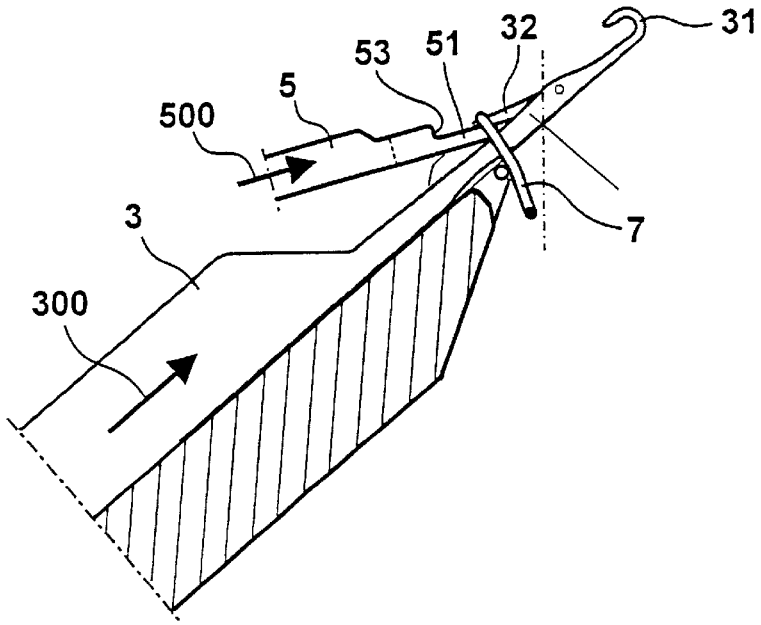
FIGS. 7*a* and 7*b* are views showing a partial cross-section through a needle bed of a flat knitting machine in different needle and stitch transfer element positions during the transfer of the stitch to the needle on to the stitch transfer element.
Figure 7:
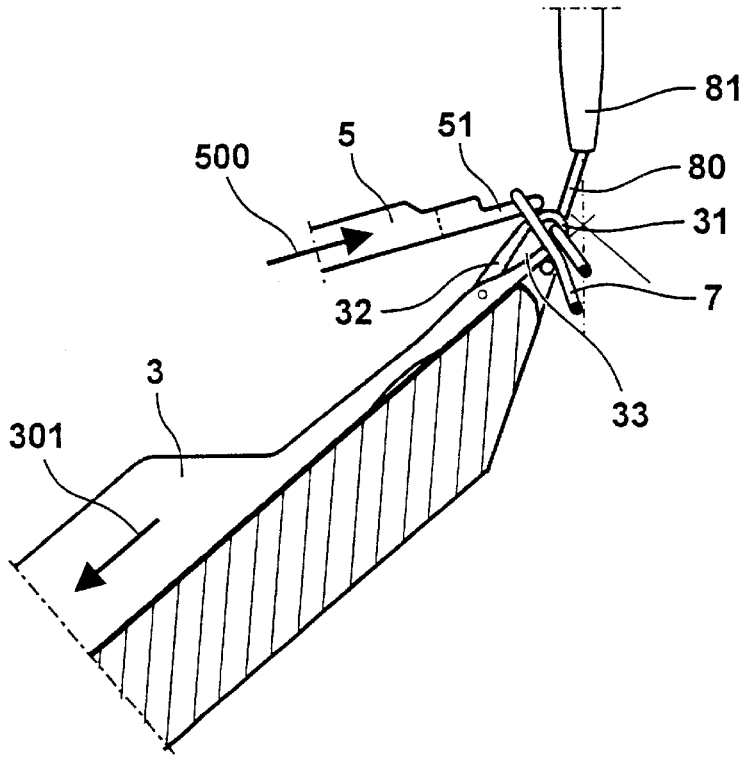

FIGS. 7*a* and 7*b* show an alternative of the stitch 7 from the needle 3 by the stitch transfer element 5. It is shown in FIG. 4 how the stitch 7 is transferred to the closed latch 32 of the needle 3 in aligned position by the stitch transfer element 5. In contrast to this, the stitch 7 in accordance with FIG. 7*a* is taken on the open latch 32 of the needle 3 in a lying position by driving the stitch transfer element 5 in direction of the arrow 500 through its tip 51. Then the needle 3 is further driven in direction of the arrow 300, a knitting thread 800 is inserted in the needle hook 31, and then the needle 3 is pulled back in direction of the arrow 301 and thereby a new stitch loop is pulled through the original stitch 7 as shown in FIGS. 7*b*.

Figure 8:
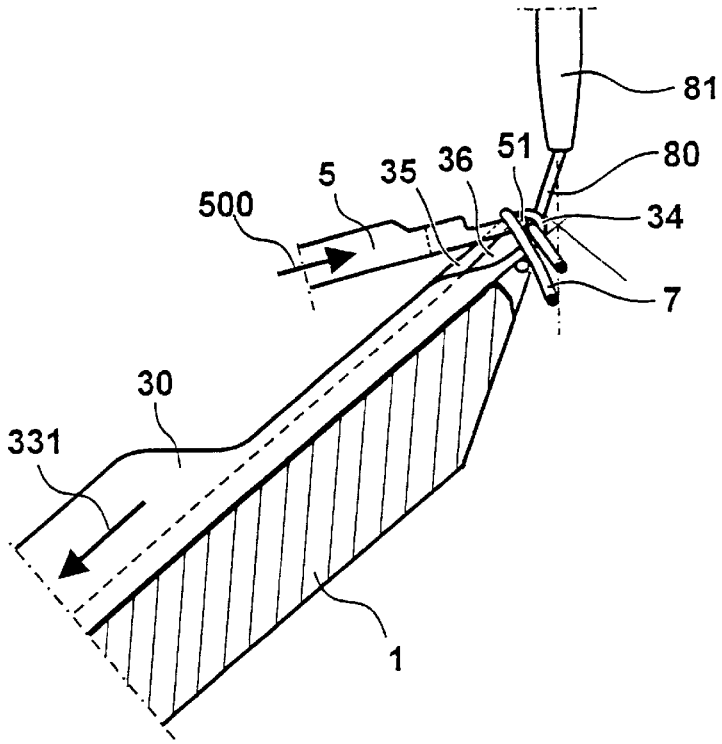
FIG. 8 is a view showing a partial cross-section corresponding to the view of FIG. 7*b*, through a needle bed of a flat knitting machine with the use of a slide needle and pulling in of a new stitch loop through a needle.

The inventive method can be performed not only with the latch needles, but also with slide needles 30 as shown in FIG. 8. The stitch 7 can be taken on the closed slide 35 of the needle 30 in a lying position by the stitch transfer element 5 by driving in the direction of the arrow 500. The further knitting thread 80 is inserted in the hook 34 of the slide needle 30. Now the needle 30 is pulled back in direction of the arrow 331, so that a new stitch loop is formed in the needle hook 34 and the stitch 7 is completely transferred from the stitch forming element 5.

Figure 9:
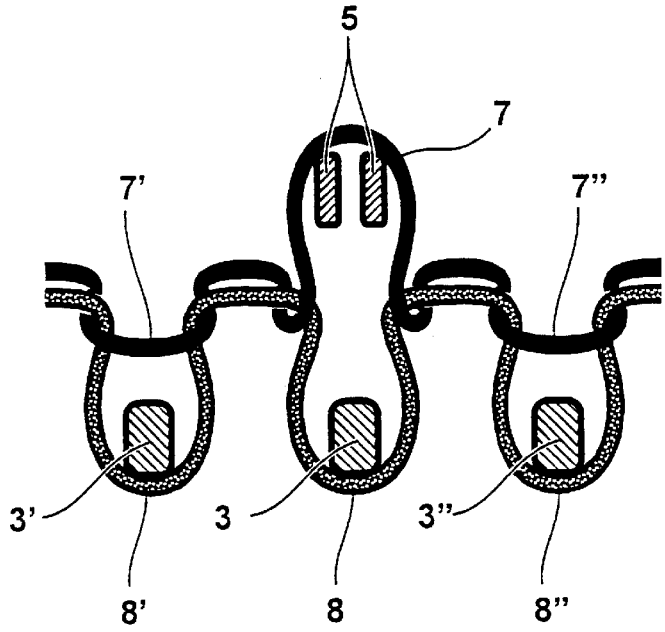
FIG. 9 is a vie schematically showing the stitch pattern after a stitch doubling in accordance with the inventive method.

FIG. 9 illustrates the stitch structure after a doubling of the stitches. From the stitches formed with the thread 70 in FIG. 4*a*, the stitch 7 is taken to the stitch transfer element 5. The stitch 7' and 7" are knitted during formation of the stitches 8' and 8". The stitch 8' is pulled through the stitch 7 formed on the stitch transfer element. The stitches 8, 8' and 8" formed with the thread 80 are suspended in the hooks on the needles 3, 3' and 3".

The inventive method is described as an example for the use on a flat knitting machine. Of course, in an analogous way, it can be carried out also on a round knitting machine.

It will be understood that each of the elements described above, or two or more together, may also find a useful application in other types of methods and constructions differing from the types described above.

While the invention has been illustrated and described as embodied in method for forming new stitches on a knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of forming new stitches on a knitting machine, comprising the steps of producing two stitches from one stitch suspended on a knitting needle, said producing includes taking the one stitch suspended on the knitting needle by a transfer element which is associated with the knitting needle but is an element which is separate from said knitting needle, and subsequently pulling a new stitch loop by the knitting needle through the stitch which is suspended on the transfer element.

2. A method as defined in claim 1; and further comprising the steps of transferring the stitch which is suspended on the stitch transfer element, to another knitting needle.

3. A method as defined in claim 1; and further comprising the steps of transferring the stitch which is suspended on the stitch transfer element, to another stitch transfer element.

4. A knitting machine, comprising knitting needles; and a transfer element provided for all needles with which new stitches must be formed and is an element which is separate from the needles, said transfer element being drivable to a stitch forming region of the knitting machine, to form new stitches by producing two stitches from one stitch suspended on a knitting needle by taking the one stitch suspended on the knitting needle by a transfer element associated with the knitting needle and subsequently pulling a new stitch loop by the knitting needle through the stitch which is suspended on the transfer element.

5. A method of forming new stitches on a knitting machine, comprising the steps of producing two stitches from one stitch suspended on a knitting needle, said producing includes taking the one stitch suspended on the knitting needle by a transfer element associated with the knitting needle, and subsequently pulling a new stitch loop by the knitting needle through the stitch which is suspended on the transfer element, providing said knitting machine with latch needles; driving the knitting needle until the stitch is located behind an open latch, subsequently inserting a thread into the stitching needle and pulling back the needle so that the stitch comes to lie on the latch which is closed, then driving the stitch transfer element associated with the needle and inserting it between legs of the stitch, and subsequently pulling back the needle so that the original stitch is suspended on the stitch transfer element and in the needle of a newly formed stitch.

6. A method of forming new stitches on a knitting machine, comprising the steps of producing two stitches from one stitch suspended on a knitting needle, said producing includes taking the one stitch suspended on the knitting needle by a transfer element associated with the knitting needle, and subsequently pulling a new stitch loop by the knitting needle through the stitch which is suspended on the transfer element, providing said knitting machine with the latch needles; driving the needle, with the use of a knitting machine with latch needles, so that the stitch comes to lie on an open latch, then driving a stitch transfer element associated with the needle and inserting it between legs of the stitch, then driving the needle further and inserting a knitting thread which is pulled during pulling back of the needle through the stitch which is suspended on the stitch transfer element so that the original stitch is suspended on the stitch transfer element and in the needle of a newly formed stitch.

7. A method of forming new stitches on a knitting machine, comprising the steps of producing two stitches from one stitch suspended on a knitting needle, said producing includes taking the one stitch suspended on the knitting needle by a transfer element associated with the knitting needle, and subsequently pulling a new stitch loop by the knitting needle through the stitch which is suspended on the transfer element; driving the needle, with the use of a knitting machine with slide needles and open slide, until the stitch comes to lie behind the open slide, then inserting a thread into the needle and closing the slide, pulling back the needle so far that the stitch comes to lie on a slide which is closed, then driving a stitch transfer element associated with the needle and inserting between legs of the stitch, and finally pulling the needle so that the original stitch is suspended on the stitch transfer element and in the needle of a newly formed stitch.

* * * * *